US006995713B2

(12) United States Patent
Le Bolzer et al.

(10) Patent No.: US 6,995,713 B2
(45) Date of Patent: Feb. 7, 2006

(54) DIELECTRIC RESONATOR WIDEBAND ANTENNA

(75) Inventors: Françoise Le Bolzer, Rennes (FR); Corinne Nicolas, La Chapelle des Fougeretz (FR); Delia Cormos, Rennes (FR); Raphael Gillard, Rennes (FR); Alexandre Laisne, Avranches (FR)

(73) Assignee: Thomson Licensing, Boulogne-Billancourt (FR)

( * ) Notice: Subject to any disclaimer, the term of this patent is extended or adjusted under 35 U.S.C. 154(b) by 35 days.

(21) Appl. No.: 10/645,213

(22) Filed: Aug. 21, 2003

(65) Prior Publication Data

US 2004/0113843 A1 Jun. 17, 2004

(30) Foreign Application Priority Data

Aug. 21, 2002 (FR) ..... 02 10429

(51) Int. Cl.
*H01Q 1/38* (2006.01)

(52) U.S. Cl. ..... 343/700 MS; 343/829

(58) Field of Classification Search ..... 343/700 MS, 343/790, 829, 873
See application file for complete search history.

(56) References Cited

U.S. PATENT DOCUMENTS 5,940,036 A * 8/1999 Oliver et al. ..... 343/700 MS

FOREIGN PATENT DOCUMENTS

EP 0801436 A2 10/1997

OTHER PUBLICATIONS

Mongla R.K. et al.: "Theoretical and Experimental Investigations on Rectangular Dielectric Resonator Antennas", IEEE Transactions of Antennas and Propagation, IEEE Inc. New York, US. vol. 45, No. 9, Sep. 1, 1997 pp. 1348-1356.
Hwang Y. et al.: Gain-enhanced miniaturized rectangular dielectric resonator antenna, Electronics Letters, IEE Stevenage, GB, vol. 33, No. 5, Feb. 27, 1997, pp. 350-352.
Wu Z. et al.: "Dielectric resonator antennas supported by 'infinite' and finite ground planes", Thenth International Conference on Antennas and Propagation (Conf. Publ. No. 436), Edinburgh, UK, Apr. 14-17, 1997, pp. 486-489, vol. 1.
French Search Report of Apr. 2, 2003.

* cited by examiner

*Primary Examiner*—Shih-Chao Chen
(74) *Attorney, Agent, or Firm*—Joseph S. Tripoli; Robert D. Shedd; Brian J. Cromarty

(57) ABSTRACT

The present invention relates to a wideband antenna consisting of a dielectric resonator or DRA mounted on a substrate with an earth plane. The resonator is positioned at a distance x from at least one of the edges of the earth plane, x being chosen such that $0 \leqq x \leqq \lambda_{diel}/2$, with $\lambda_{diel}/2$ the wavelength defined an the dielectric of the resonator. This invention applies to wireless networks.

4 Claims, 2 Drawing Sheets

DIELECTRIC RESONATOR WIDEBAND ANTENNA

The present invention relates to a wideband antenna consisting of a dielectric resonator mounted on a substrate with an earth plane.

BACKGROUND OF THE INVENTION

Within the framework of the development of antennas associated with mass-market products and used in domestic wireless networks, antennas consisting of a dielectric resonator have been identified as an interesting solution. Specifically, antennas of this type exhibit good properties in terms of passband and radiation. Moreover, they readily take the form of discrete components that can be surface mounted. Components of this type are known by the term SMC components. SMC components are of interest, in the field of wireless communications for the mass market, since they allow the use of low-cost substrates, thereby leading to a reduction in costs while ensuring equipment integration. Moreover, when RF frequency functions are developed in the form of SMC components, good performance is obtained despite the low quality of the substrate and integration is often favoured thereby.

Moreover, new requirements in terms of throughput are leading to the use of high throughput multimedia networks such as the Hyperlan2 and IEEE 802.11A networks. In this case, the antenna must be able to ensure operation over a wide frequency band. Now, dielectric resonator type antennas or DRAs consist of a dielectric patch of any shape, characterized by its relative permittivity. The passband is directly related to the dielectric constant which therefore conditions the size of the resonator. Thus, the lower the permittivity, the more wideband the DRA antenna, but in this case, the component is bulky. However, in the case of use in wireless communication networks, the compactness constraints demand a reduction in the size of dielectric resonator antennas, possibly leading to incompatibility with the bandwidths required for such applications.

BRIEF DESCRIPTION OF THE INVENTION

The present invention defines a design rule relating to the positioning of the dielectric resonator on its substrate which allows a widening of the passband without impairing its radiation.

The present invention relates to a wideband antenna consisting of a dielectric resonator mounted on a substrate forming an earth plane. In this case, the resonator is positioned at a distance x from at least one of the edges of the earth plane, x being chosen such that $0 \leqq x \leqq \lambda_{dielectric}/2$, with $\lambda_{dielectric}$ the wavelength defined in the dielectric of the resonator.

According to a preferred embodiment, the earth plane-forming substrate consists of an element of dielectric material at least one face of which is metallized and constitutes an earth plane for the resonator or DRA.

When the face carrying the resonator is metallized, the resonator is fed by electromagnetic coupling through a slot made in the metallization by a feedline made on the opposite face, in general, in microstrip technology. It may also be excited by coaxial probe or by a coplanar line. When the opposite face is metallized, the resonator is fed by direct contact via a feedline made on the face carrying the resonator or else by coaxial probe.

BRIEF DESCRIPTION OF THE DRAWINGS

Other characteristics and advantages of the present invention will become apparent on reading the description given hereinbelow of a preferred embodiment, this description being given with reference to the appended drawings, in which.

DESCRIPTION OF PREFERRED EMBODIMENTS

Figure 1:
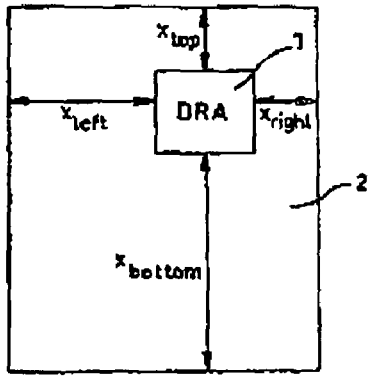
FIG. 1 is a diagrammatic view from above describing the mounting of a dielectric resonator on a substrate.

Represented diagrammatically in FIG. 1 is a dielectric resonator 1 of rectangular shape, mounted on a substrate 2 of rectangular shape, the substrate 2 being furnished with an earth plane consisting, for example, of a metallization of its upper face when the substrate is a dielectric substrate.

It has been observed that the position of the resonator 1 had an influence on its passband in so far as the resonator was positioned closer to or further from the edges of the earth plane. Thus, it appears that when one of the distances Xtop or Xright for example, between the resonator 1 and the edge of the substrate 2 is small enough, the passband of the resonator increases while retaining similar radiation. This widening of the passband can be explained by the proximity of the edges of the earth plane. Given its finiteness, the intrinsic operation of the resonator is slightly modified since the truncated sides will contribute to the radiation and the resulting structure is formed of the resonator and of the finite earth plane exhibits a greater bandwidth than that of a conventional resonator.

Thus, in accordance with the present invention, a wideband antenna is obtained when the resonator is positioned at a distance x from at least one of the edges of the earth plane, x being chosen such that $0 \leqq x \leqq \lambda_{diel}/2$, with $\lambda_{diel}$ the wavelength defined in the dielectric of the resonator.

Figure 3:
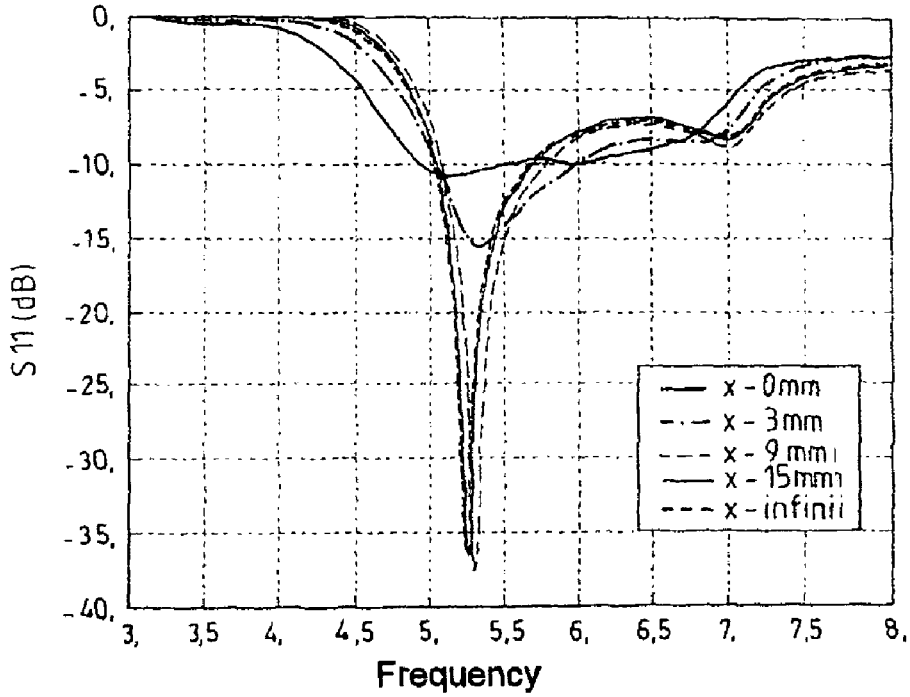
FIG. 3 represents various curves giving the adaptation of the resonator as a function of distance x with respect to at least one edge of the earth plane.
Figure 4:
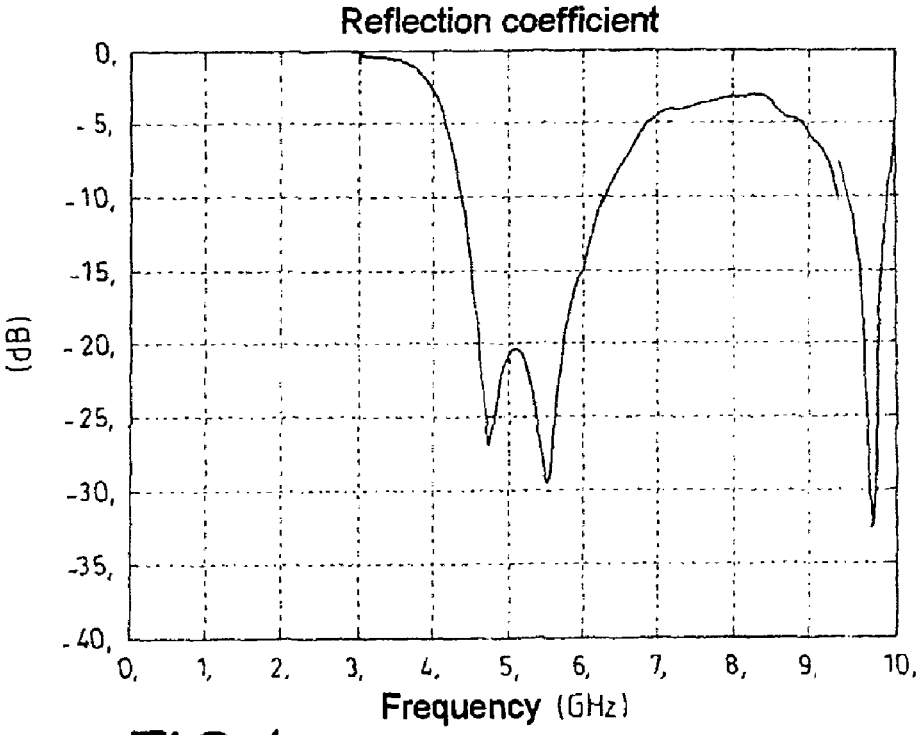
FIG. 4 represents a curve giving the reflection coefficient of a very wideband resonator as a function of frequency.

A practical embodiment of the present invention will now be described with reference to FIGS. 2 to 4, in the case of a study carried out with a rectangular dielectric resonator fed via a feedline in microstrip technology.

The corresponding structure is represented in FIG. 2. In this case, the resonator 10 consists of a rectangular patch of dielectric material of permittivity $\in r$. The resonator can be made from a dielectric material based on ceramic or a metallizable plastic of the polyetherimide type filled with dielectric or polypropylene.

In a practical manner, the resonator is made from a dielectric of permittivity $\in r=12.6$. This value corresponds to the permittivity of a base ceramic material, namely a low-cost material from the manufacturer NTK, and exhibits the following dimensions:

a=10 mm b=25.8 mm d=4.8 mm.

In a known manner, the resonator 10 is mounted on a dielectric substrate 11 of permittivity ∈'r, characterized by its low RF frequency quality (namely significant distortion in the dielectric characteristics and significant dielectric loss).

Figure 2A:
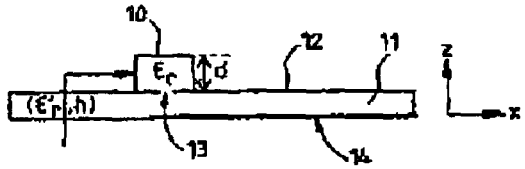
FIGS. 2A and 2B are respectively a sectional view and a view from above of a wideband antenna in accordance with an embodiment of the present invention.
Figure 2B:
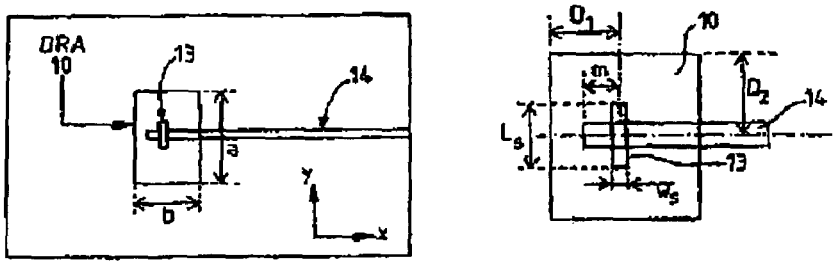

As represented in FIG. 2A, the external faces of the substrate 11 are metallized and exhibit a metallic layer 12 forming an earth plane on its upper face. Moreover, as represented more clearly in FIG. 2B, the resonator 10 is fed in a conventional manner by electromagnetic coupling through a slot 13 made in the earth plane 12 by way of a microstrip line 14 etched onto the previously metallized lower face. In the embodiment of FIG. 2, the rectangular substrate 11 used is a substrate of FR4 type exhibiting an ∈'r of around 4.4 and a height h equal to à 0.8 mm. It is of infinite size, that is to say the distances Xtop, Xleft, Xright and Xbottom are large, namely greater than the wavelength in vacuo. The slot/line feed system is centred on the resonator, namely D1=b/2 and D2=a/2. The line exhibits in a conventional manner a characteristic impedance of 50Ω and the dimensions of the slot are equal to WS=2.4 mm and LS=6 mm. The microstrip line crosses the slot perpendicularly with an overhang m with respect to the centre of the slot equal to 3.3 mm. Under these conditions, the resonator operates at 5.25 and exhibits a passband of 664 MHz (12.6%) with almost omnidirectional radiation.

In accordance with the present invention, the position of the resonator 10 has been modified so as to be located in proximity to one of the corners of the substrate 11, namely in proximity to the top right corner of the substrate. To show the widening of the passband, simulations have been performed as a function of the distances Xtop, Xright on 3D electromagnetic simulation software. The results obtained are given in the table below.

TABLE 1

| $X = X_{top} = X_{right}$ (mm) | $[F_{min}–F_{max}]$ (GHz) | Band (MHz) (%) | S11 (dB) |
|---|---|---|---|
| 0 | [4.95–5.5] | 550, 10.7 | −10.6 |
| 3 | [5.45–5.98] | 935, 17.5 | −15.5 |
| 6 | [5.08–5.87] | 790, 14.8 | −22 |
| 9 | [5.083–5.773] | 690, 13 | −37 |
| 12 | [5.073–5.71] | 637, 12 | −39 |
| 15 | [5.058–5.687] | 629, 11.95 | −36 |
| infinite | [5.04–5.704] | 664, 12.6 | −35.8 |

It is therefore seen, in accordance with the results of Table 1, that the more the distance between the resonator and the edges of the earth plane decreases, the more the passband increases. It is seen however, according to FIG. 3, that the adaptation level deteriorates with the lowest values of x.

Moreover, onwards of a sufficiently large distance x, namely x>λdiel/2 with in this case λdiel=3/(5.25*10*$\sqrt{}$12.6)=16 mm), the positioning of the resonator no longer has any influence on the passband which then becomes substantially equal to that of the configuration with an infinite earth plane.

Figure 5A:
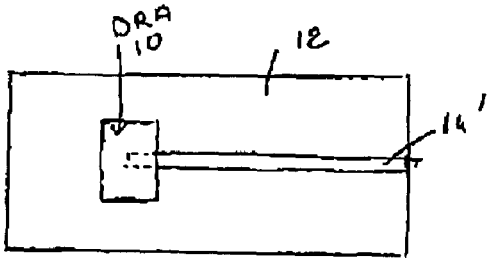
FIGS. 5A and 5B are respectively a sectional view and a view from above of a wideband antenna in accordance with another embodiment of the present invention.
Figure 5B:
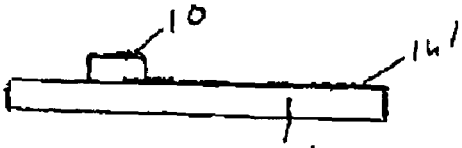

The present invention has been described above with reference to a resonator of rectangular shape. However, it is obvious to the person skilled in the art that the resonator can have other shapes, in particular square, cylindrical, hemispherical or the like. Moreover, the resonator is fed using a microstrip line and a slot; however, the resonator may also be fed via a coaxial probe or via a microstrip line 14 with direct contact as shown in FIG. 5A and FIG. 5B or via any type of electromagnetic coupling.

Another exemplary embodiment making it possible to obtain a very wideband antenna will now be given. Specifically, the simulations performed have made it possible to demonstrate that, in certain specific configurations conditioned by the dimensioning of the dielectric resonator, the first higher mode of the resonator $TE_{211X}$ is close to the fundamental mode $TE_{111X}$. In this case, the positioning of the resonator in proximity to one or more edges of the earth plane enables the operating frequencies of these two modes to be brought close together, this having the effect of giving very wideband adaptation, as represented in FIG. 4.

Table 2 gives the characteristic dimensions of a dielectric resonator for obtaining very wideband adaptation.

TABLE 2

| | |
|---|---|
| Frequency | 5.3 GHz |
| a | 10 mm |
| b | 25.8 mm |
| d | 4.8 mm |
| ∈r | 12.6 |
| $X_{right} = X_{top}$ | 0 mm |
| Ls | 7 mm |
| Ws | 2.4 mm |
| m | 4.5 mm |
| D1 | 12.9 |
| D2 | 5 |
| Passband (GHz) | (4.4–6.3) GHz |
| Bandwidth | 1.9 GHz (35%) |

What is claimed is:

1. A wideband antenna comprising a dielectric resonator mounted on a substrate comprising an earth plane, wherein the dielectric resonator is positioned at a distance x from at least one of the edges of the earth plane, x being chosen such that $0 \leqq x \leqq \lambda_{diel}/2$, with $\lambda_{diel}$ the wavelength defined in the dielectric resonator for widening the passband.

2. The Antenna according to claim 1, wherein the substrate comprising an earth plane consists of an element of dielectric material at least one face of which is metallized and constitutes the earth plane.

3. The Antenna according to claim 2, wherein the face carrying the resonator is metallized, and the resonator is fed by coupling through a slot made in the metallization by a feedline made on the opposite face.

4. The Antenna according to claim 2, wherein the face opposite the face carrying the resonator is metallized and the resonator is fed via a feedline made on the face carrying the resonator.

* * * * *